US005464684A

United States Patent [19]

Vogelsang et al.

[11] Patent Number: 5,464,684

[45] Date of Patent: Nov. 7, 1995

[54] HYBRID YARN COMPRISING A CORE OF INTERMIXED POLYAMIDE FILAMENTS AND REINFORCING RILAMENTS WHEREIN THE CORE IS WRAPPED BY A POLYAMIDE FIBER

[75] Inventors: Joerg Vogelsang, Harthausen; Giorgio Greening, Rossdorf; Regina Laws, Weinheim; Peter Ittemann, Mannheim, all of Germany

[73] Assignee: Cytec Technology Corp., West Paterson, N.J.

[21] Appl. No.: 970,455

[22] Filed: Nov. 2, 1992

[51] Int. Cl.[6] ..... D02G 3/02; D02G 3/36; D03D 3/00; B32B 5/06

[52] U.S. Cl. ..... 428/229; 57/210; 57/224; 57/229; 57/244; 428/297; 428/373; 428/374; 428/377

[58] Field of Search ..... 57/224, 229, 210, 57/140, 244; 428/373, 377, 229, 297, 374; 28/220, 282, 181, 167

[56] References Cited

U.S. PATENT DOCUMENTS

| | | | |
|---|---|---|---|
| 3,625,809 | 12/1971 | Caroselli et al. | 57/140 |
| 4,259,394 | 3/1981 | Khan | 428/229 |
| 5,177,840 | 1/1993 | Laws | 28/220 |
| 5,227,236 | 7/1993 | Handermann | 428/377 |

FOREIGN PATENT DOCUMENTS

| | | | |
|---|---|---|---|
| 0156599 | 2/1985 | European Pat. Off. | D02G 3/04 |
| 2105247 | 3/1983 | United Kingdom | B32B 17/04 |

*Primary Examiner*—James D. Withers
*Attorney, Agent, or Firm*—Bernard Lau; Claire M. Schultz

[57] ABSTRACT

A hybrid yarn which comprises an intimate blend of reinforcing fibers and matrix-forming thermoplastic fibers made of low viscosity polyamide and has been overwrapped with a further polyamide yarn is useful for producing laid, woven, knitted, braided and wound structures, which in turn can be consolidated into fiber composites.

10 Claims, No Drawings

HYBRID YARN COMPRISING A CORE OF INTERMIXED POLYAMIDE FILAMENTS AND REINFORCING RILAMENTS WHEREIN THE CORE IS WRAPPED BY A POLYAMIDE FIBER

The present invention concerns hybrid yarn composed of polyamide fiber and reinforcing fiber. Hybrid yarns comprising intimate blends of thermoplastic fiber and reinforcing fiber have been used to an increasing extent in recent years for producing high performance composite materials. The hybrid yarns and the sheetlike structures produced therefrom are very flexible and hence formable into articles with a very small radius of curvature. On consolidation by pressing at above the softening point of the thermoplastic, the thermoplastic melts and forms a matrix embedding the reinforcing fiber with orientation in a preferred direction.

EP-B-156 599 describes a process for preparing hybrid yarn from carbon fiber and thermoplastic fiber wherein the two fibers are spread, combined with each other over rolls or rods to produce an intermixed yarn, and the intermixed yarn is then optionally overwrapped with a further, thermoplastic yarn. Such overwrapping results in good yarn compaction, so that the yarn is satisfactorily weavable even without additional application of a size. A hybrid yarn based on the thermoplastics mentioned in the Examples of EP-B-156 599 is not suitable for producing inexpensive and readily processible high performance composite materials. In principle, however, that is possible with polyamides, which are mentioned in the description part of EP-B-156 599 besides many others. Yet if hybrid yarns are produced from the customary high and medium viscosity polyamide fibers it has been found that the time required for consolidating to the composite is comparatively long and that some mechanical properties of the composite material, in particular the transverse tensile strength, are inadequate.

It is an object of the present invention to provide a hybrid yarn which is free of these disadvantages.

We have found that this object is achieved by using a polyamide of extremely low viscosity.

The invention accordingly provides a hybrid yarn composed of polyamide fiber A and reinforcing fiber B within which the individual filaments of the two kinds of fiber have been intermixed and which is overwrapped by a polyamide yarn A', wherein the polyamide A has a melt viscosity of less than 220 Pa.s (measured in accordance with DIN 54 811 at a shear rate of 100 $s^{-1}$ and at 30° C. above the melting point or, if more applicable, the glass transition temperature of the polyamide).

GB-A-2 105 247 describes fiber composite materials produced by overwrapping a fiber core of reinforcing fiber with a thermoplastic yarn. In Example 2 the core consists of a carbon fiber yarn and two ends of a nylon multifilament yarn, and the overwrapping yarn used is likewise a nylon multifilament yarn. In the fiber core the three multifilament yarns are in a side by side arrangement; no intermixing of the individual filaments has taken place and the fiber composite therefore has a low level of mechanical properties.

Preferred reinforcing fiber B is carbon fiber or glass fiber. In addition it is also possible to use fiber made of ceramic materials, silicon carbide and boron nitride and also fiber made of polymers having a softening point more than 70° C. above the softening point of polyamide A, for example made of polyether ketone or wholly aromatic polyamides.

The polyamide fiber A can be made of the customary aliphatic or partly aromatic homo- and copolyamides, preferably nylon-6 and nylon-6.6. In addition it is also possible to use nylon-6.6 T, nylon-6.10, nylon-10, and a polyamide of adipic acid and 1,3-xylylenediamine, and also copolyamides based on the corresponding monomers.

The polyamides A of the invention have a melt viscosity of less than 220, preferably less than 180, Pa.s, measured in accordance with DIN 54 811 at a shear rate of 100 $s^{-1}$ and at 30° C. above the melting point (in the case of partly crystalline polyamides) or above the glass transition temperature (in the case of amorphous polyamides) of the polymer.

The hybrid yarns are preferably produced as described in EP-B-156 599 by separately spreading the two kinds of fiber by impinging with air and then intermixing them by bringing them together over rolls or rods. The spreading can in principle also be effected by means of a liquid jet, by electrostatic charging or by separating the individual filaments by means of combs. The aforementioned measures produce intimate intermixing of the individual filaments, so that the intermixed yarn comprises a uniformly random distribution of thermoplastic fiber and reinforcing fiber. However, such intimate intermixing is not necessary for all applications; it is also possible to dispense with the spreading of the starting fibers and intermix them by simple methods, for example by pulling them together over rolls or rods or by intermingling them together in an air stream.

What is essential is that the hybrid yarn produced by intermixing of the polyamide and reinforcing fibers should be overwrapped. This is done with a polyamide yarn A', which preferably comprises the same polyamide as the polyamide fiber A. However, it is also possible to use a different polyamide, including in principle a polyamide whose melt viscosity is above 220 Pa-s. The overwrapping yarn should preferably have a linear density of from 40 to 100 dtex.

The mixing ratios should preferably be selected in such a way that the ready-produced hybrid yarn contains from 26 to 80% by weight of polyamide fiber A, from 20 to 75% by weight of reinforcing fiber B, and from 0.2 to 3% by weight of overwrapping yarn A'.

The hybrid yarn of the invention can be processed without additional application of a size into woven, knitted or braided structures. A plurality of yarns can be arranged in parallel to form laid structures or bands, in which case a plurality of such laid structures can be stacked in parallel or at predetermined angles to one another. Furthermore, the yarns can be wound onto cores to form tubes. These semi-fabricated products can then be consolidated by pressing at above the softening point of the polyamide to form composite materials with or without molding. It is advantageous in this case first to apply a size to the semi-fabricate to shorten the consolidation time. This size is preferably an aqueous dispersion of a thermoplastic which is compatible with the polyamide A.

The composite materials based on the hybrid yarn of the invention can be used to produce high-strength consumer goods, for example tennis racket frames, baseball bats, hockey sticks, frames for badminton and squash rackets, and also bicycle frames.

In the Examples, the parts and percentages are by weight.

EXAMPLES

General procedure:

Ultramid® B, a nylon 6 from BASF AG of variable melt viscosity, was spun by a single-stage spinning-drawing process into a 217-tex 184-filament yarn. Two of these yarns were intimately intermixed together with a Celion® G30-

500 carbon fiber yarn from Celion Carbon Fibers, consisting of 12,000 individual carbon filaments, as described in EP 156 599, by spreading the individual multifilament yarns by impinging with air and then bringing them together by passing them over and under two rods. They were then overwrapped with a 6 tex auxiliary yarn (consisting of 12 individual filaments) composed of Ultramid® B (melt viscosity 260 Pa.s). The overwrapping rate for the auxiliary yarn was 150 turns/m of the resulting hybrid yarn. The product had a uniform distribution of thermoplastic and carbon fibers, containing 64.1% of carbon fiber
34.8% of polyamide fiber A
1.1% of overwrapping yarn A'.

Some samples of the hybrid yarn were then passed through an aqueous size dispersion prepared from an alcoholic solution of a terpolyamide (ELVAMID 8063 from DuPont). The resulting size addon was 0.6%. In the table below these versions are signified by (S).

The thus hybridized and overwrapped yarn was then used to prepare a consolidated specimen. To obtain a highly unidirectional orientation of the reinforcing fiber, the hybridized yarn was wound onto a metal reel which had on the inside a free surface area of 220 mm× 270 mm. Six plies were wound in total (three on each side), and then the reel was placed between two purpose-built steel molding tools for application of pressure and heat to the wound hybrid yarn. The hybrid yarn was consolidated in a hot press.

First the tool was placed into the press, which had been preheated to a temperature T, and was left under a pressure of 5.5 bar for 15 minutes in order to heat the hybridized yarn to T. Then the pressure was raised to 14 bar within a minute and this pressure was maintained for Z minutes. Then the mold was cooled down in the same press for 10 minutes by sliding cooling cassettes between the hybrid yarn tool and the press platens. On opening the tool it was found to contain a 2 mm thick, consolidated tile having a smooth pore-free surface.

To test the adhesion of the polyamide matrix to the carbon fibers, the material was subjected to a 90° tensile test under SAC-MA 4-88. For this the 2 mm thick tile was cut with a diamond saw into 25 mm×210 mm specimens, taking care to ensure a precisely parallel arrangement of the reinforcing fibers relative to the 25 mm long side of the specimens. The tensile strength is shown in the table.

TABLE

| Example | Viscosity [Pa·s] | T [°C.] | Z [min] | Tensile strength [MPa] |
|---|---|---|---|---|
| 1 | 260 | 260 | 20 | 48.4 |
| 2 | 260 | 260 | 5 | 27.4 |
| 3 | 130 | 260 | 20 | 63.2 |

TABLE-continued

| Example | Viscosity [Pa·s] | T [°C.] | Z [min] | Tensile strength [MPa] |
|---|---|---|---|---|
| 3S | 130 | 260 | 20 | 64.0 |
| 4 | 130 | 260 | 5 | 44.2 |
| 4S | 130 | 260 | 5 | 60.3 |
| 5 | 130 | 270 | 5 | 49.8 |
| 5S | 130 | 270 | 5 | 63.8 |
| 6 | 130 | 240 | 20 | 44.8 |

Examples 1 and 2 are not according to the invention.

We claim:

1. A hybrid yarn comprising polyamide fiber A and reinforcing fiber B within which the individual filaments of the two kinds of fiber have been intermixed and which is overwrapped by a polyamide yarn A' wherein the polyamide A has a melt viscosity of less than 220 Pa.s.

2. A hybrid yarn as claimed in claim 1, wherein the polyamide A is a nylon-6 having a melt viscosity of less than 180 Pa.s.

3. A hybrid yarn as claimed in claim 1, wherein the polyamide A is a nylon-6.6 having a melt viscosity of less than 180 Pa.s.

4. A hybrid yarn as claimed in claim 1, wherein polyamide A and polyamide A' are identical polymers.

5. A hybrid yarn as claimed in claim 1, wherein the reinforcing fiber B is carbon fiber.

6. A hybrid yarn as claimed in claim 1, wherein the reinforcing fiber B is glass fiber.

7. A laid, wound, woven, knitted or braided structure comprised of a hybrid yarn, the hybrid yarn comprising polyamide fiber A and reinforcing fiber B within which the individual filaments of the two kinds of fiber have been intermixed and which is overwrapped by a polyamide yarn A', wherein the polyamide A has a melt viscosity of less than 220 Pa.s.

8. A laid, wound, woven, knitted or braided structure as claimed in claim 7, further comprising a size on the structure comprised of the hybrid yarn.

9. A composite material prepared by the process of consolidating a laid, wound, woven, knitted or braided structure comprised of a hybrid yarn, the hybrid yarn comprising polyamide fiber A and reinforcing fiber B within which the individual filaments of the two kinds of fiber have been intermixed and which is overwrapped by a polyamide yarn A', wherein the polyamide A has a melt viscosity of less than 220 Pa.s.

10. A composite material as claimed in claim 9 in the form of a piece of sports equipment, in particular in the form of a tennis racket frame.

* * * * *